US006010386A

United States Patent [19]

Okamoto et al.

[11] Patent Number: 6,010,386

[45] Date of Patent: Jan. 4, 2000

[54] METHOD FOR REMOVING BLACK FILM FROM SKIRT OF CRT FRONT PANEL

[75] Inventors: Masahisa Okamoto, Kyoto; Akihiro Yamaguchi, Takatsuki, both of Japan

[73] Assignee: Matsushita Electronics Corporation, Takasuki, Japan

[21] Appl. No.: 09/203,316

[22] Filed: Dec. 1, 1998

[30] Foreign Application Priority Data

Dec. 3, 1997 [JP] Japan ..... 9-332643

[51] Int. Cl.[7] ..... H01J 9/00

[52] U.S. Cl. ..... 445/59

[58] Field of Search ..... 445/59

[56] References Cited

U.S. PATENT DOCUMENTS 5,135,420 8/1992 Sumi et al. ..... 445/59

FOREIGN PATENT DOCUMENTS 5-28916 2/1993 Japan .
6-150822 5/1994 Japan .
8-17350 1/1996 Japan .

OTHER PUBLICATIONS

Patent Abstracts of Japan, publication No. 08017350A, published Jan. 19, 1996.
Patent Abstracts of Japan, publication No. 05028916A, published Feb. 5, 1993.
Patent Abstracts of Japan, publication No. 06150822A, published May 31, 1994.

*Primary Examiner*—Kenneth J. Ramsey
*Attorney, Agent, or Firm*—Rosenthal & Osha L.L.P.

[57] ABSTRACT

A method for manufacturing a cathode ray tube includes the steps of applying a black substance to the inner surface of a glass panel, immersing the skirt inner wall and the sealing surface of the glass panel in a glass dissolving liquid for etching, and removing the black substance adhered to the skirt inner wall and the sealing surface by a removing means while spraying a cleaning liquid on the inner surface of the glass panel, thereby forming the desired black matrix film on the front inner wall of the glass panel. Therefore, the excess black substance coating film adhered to the skirt inner wall and the sealing surface of the skirt portion of the glass panel can be removed effectively, and the occurrence of minute flaws that adversely affect the production and life of the cathode ray tube is prevented.

10 Claims, 7 Drawing Sheets

METHOD FOR REMOVING BLACK FILM FROM SKIRT OF CRT FRONT PANEL

FIELD OF THE INVENTION

The present invention relates to a method for manufacturing a cathode ray tube used as a display for a television receiver or the like.

BACKGROUND OF THE INVENTION

As shown in FIG. 5, a phosphor screen (not shown) is formed on the front inner wall 4 of the glass panel 1 of a cathode ray tube by three kinds, red, blue and green, of phosphor matrices to reproduce the three colors. In addition, a black matrix film 7 is formed on the front inner wall 4 by filling the space among the phosphor matrices with a non-luminescent black substance such as graphite. The black matrix film 7 provides a margin for beam landing and is intended to improve contrast.

In general, the black matrix film 7 is formed by coating the inner surface of the glass panel 1 with a photosensitive material, exposing and developing the photosensitive material properly to form the desired photosensitive pattern, coating the inner surface of the glass panel 1 with a graphite slurry, which is a black substance, and removing the photosensitive pattern with a reverse liquid.

In this method for forming the black matrix film 7, the excess black substance coating film is peeled and removed by the reverse operation after coating the inner surface of the glass panel 1 with the black substance and drying the black substance. Therefore, the black substance coating film adhered to the skirt inner wall 5 and the sealing surface 6 of a skirt portion 3, which are regions where the photosensitive material is washed away and is not adhered, unavoidably remains in the inner surface of the glass panel 1.

Accordingly, the following methods have conventionally been employed to remove such an excess black substance coating film. The excess black substance coating film is cleaned and removed by immersing the skirt inner wall 5 and the sealing surface 6 in hot water, to which ultrasonic vibration is applied, and pouring hot water onto the inner surface of the glass panel 1 at the same time, without using a glass dissolving liquid, such as hydrogen fluoride or ammonium fluoride (see Japanese Laid-Open Publication (Tokkai Hei) No. 5-28916). Furthermore, as shown in FIG. 7, a black substance coating film 8 that is adhered to the skirt inner wall 5 and the sealing surface 6 is removed by washing the black substance coating film 8 away with water 72 using a water-pouring machine 71, while rotating the glass panel 1 in a wet state before the black substance coating film dries.

In addition, Japanese Laid-Open Publication (Tokkai Hei) No. 6-150822 and Japanese Laid-Open Publication (Tokkai Hei) No. 8-17350 disclose methods for removing dirt adhered to the inner surface of the glass panel and a phosphor slurry adhered to the inner surface of the skirt portion by injecting high-pressure water from a nozzle to the inner surface of the glass panel.

With the removing method involving ultrasonic vibration, however, it is very difficult to completely clean and remove the excess black substance coating film once the black substance coating film is dried because a glass dissolving liquid, such as hydrogen fluoride, is not used.

Furthermore, with the removing method using water pouring, it is impossible to perform sufficient cleaning unless a strong water flow is used because the black substance coating film in a wet state is cleaned only with a strong water flow. If such a strong water flow is discharged, water splashes from the discharge opening of the water-pouring machine, contaminating the front inner wall of the glass panel. Therefore, the formation of the black matrix film can be adversely affected.

As described above, with the conventional removing methods, it is not easy to sufficiently clean and remove the excess black substance coating film. Furthermore, when trying to completely clean and remove the excess black substance coating film, a long time is required for cleaning, and water splashing damages the black matrix film.

SUMMARY OF THE INVENTION

In order to solve the above-mentioned problems, it is an object of the present invention to provide a method for manufacturing a cathode ray tube that can effectively remove the excess black substance coating film adhered to the skirt inner wall and the sealing surface of the skirt potion of the glass panel and does not adversely affect the production and life of the cathode ray tube.

In order to achieve the above object, the present invention provides a method for manufacturing a cathode ray tube, including the steps of applying a black substance to the inner surface of a glass panel, immersing the skirt inner wall and the sealing surface of the glass panel in a glass dissolving liquid for etching, and removing the black substance adhered to the skirt inner wall and the sealing surface by a removing means while spraying a cleaning liquid on the inner surface of the glass panel, thereby forming a desired black matrix film on the front inner wall of the glass panel. According to this method, the inner surface of the glass panel is protected with the cleaning liquid by spraying the cleaning liquid on the inner surface of the glass panel after immersing the skirt inner wall and the sealing surface in a glass dissolving liquid for etching. Therefore, even if the black substance, the etchant and the like are scattered on the inner surface of the glass panel by the removing means, the formation of the black matrix film on the front inner wall of the glass panel is not adversely affected.

It is preferable that the cleaning liquid is sprayed on the front inner wall of the glass panel before the black substance adhered to the skirt inner wall and the sealing surface is removed by the removing means. According to the preferable example, the front inner wall of the glass panel is protected with the cleaning liquid by spraying the cleaning liquid on the front inner wall of the glass panel before the black substance, the etchant and the like are scattered on the inner surface of the glass panel by the removing means. Therefore, even if the black substance, the etchant and the like are scattered on the front inner wall of the glass panel by the removing means, the formation of the black matrix film on the front inner wall of the glass panel is not adversely affected.

It is preferable that the removing means is means of spraying the cleaning liquid on the skirt inner wall and the sealing surface. According to the preferable example, the black substance adhered to the skirt inner wall and the sealing surface is removed by the pressure of the cleaning liquid. Therefore, damage to the skirt inner wall and the sealing surface can be prevented.

It is preferable that at least one discharge opening for cleaning the skirt portion is provided from a discharge opening support on a central axis of the glass panel toward the skirt inner wall and the sealing surface, and that the cleaning liquid is sprayed on the skirt inner wall and the sealing surface from the discharge opening for cleaning the skirt portion. According to the preferable example, the black substance adhered to the skirt inner wall and the sealing surface can be removed by the removing means without rotating the heavy glass panel, that is, with the glass panel fixed. Therefore, the production facilities of the cathode ray tube can be simplified. It is preferable that the cleaning liquid is sprayed on the skirt inner wall and the sealing surface from the discharge opening for cleaning the skirt portion while rotating at least one of the glass panel and the discharge opening for cleaning the skirt portion around the central axis of the glass panel. According to the preferable example, the cleaning liquid can be sprayed substantially uniformly over the entire area of the skirt inner wall and the sealing surface. It is preferable that the glass panel and the discharge opening for cleaning the skirt portion are rotated in opposite directions to each other. According to the preferable example, the pressure of the cleaning liquid increases when the cleaning liquid reaches the skirt inner wall and the sealing surface. Therefore, the effect of removing the black substance adhered to the skirt inner wall and the sealing surface can be improved. As a result, the black substance can be removed in a short time, which improves the productivity. In addition, the time during which the etchant scatters on the inner surface of the glass panel can be shortened, providing no adverse effect (for example, peeling of the black matrix film) on the formation of the black matrix film on the front inner wall of the glass panel. Furthermore, the odor of the etchant in the black matrix film can be reduced, and the degree of vacuum of the cathode ray tube can be increased. It is preferable that a plurality of the discharge openings for cleaning the skirt portion are provided, and that each of the discharge opening for cleaning the skirt portion is reciprocated in a predetermined angle range. According to the preferable example, the pressure direction of the cleaning liquid with respect to the skirt inner wall and the sealing surface is changed. Therefore, the effect of removing the black substance adhered to the skirt inner wall and the sealing surface can be improved. As a result, the black substance can be removed in a short time, which improves the productivity. In addition, the time during which the etchant scatters on the inner surface of the glass panel can be shortened, providing no adverse effect (for example, peeling of the black matrix film) on the formation of the black matrix film on the front inner wall of the glass panel. Furthermore, the odor of the etchant in the black matrix film can be reduced, and the degree of vacuum of the cathode ray tube can be increased. It is preferable that the discharge opening for cleaning the skirt portion is inclined at a predetermined angle on the opposite side to the front inner wall of the glass panel with respect to a plane perpendicular to the central axis of the glass panel. According to the preferable example, the scattering of the black substance, the etchant and the like onto the front inner wall of the glass panel can be reduced. Therefore, the formation of the black matrix film on the front inner wall of the glass panel is not adversely affected. Furthermore, the odor of the etchant in the black matrix film can be reduced, and the degree of vacuum of the cathode ray tube can be increased. It is preferable that the predetermined angle is in the range of 2 to 6°. Also, it is preferable that a discharge opening for cleaning the front portion is provided in the upper portion of the discharge opening support, and that the cleaning liquid is sprayed on the front inner wall of the glass panel from the discharge opening for cleaning the front portion.

DETAILED DESCRIPTION OF THE INVENTION

The step of removing a black substance coating film in a method for manufacturing a cathode ray tube according to the present invention will be described with respect to the figures below.

Figure 3:
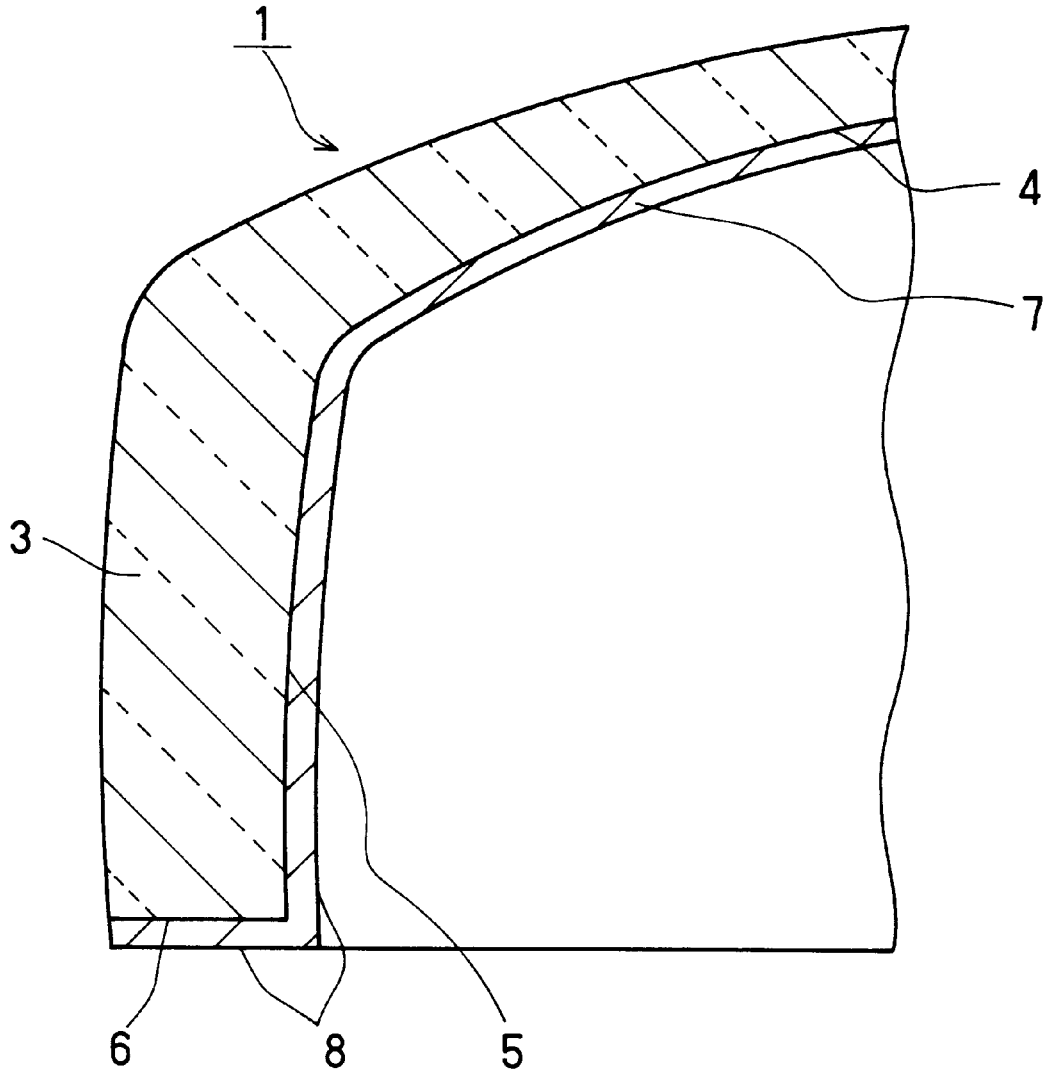
FIG. 3 is an enlarged sectional side view of a portion of the glass panel before removing the excess black substance coating film in the method for manufacturing a cathode ray tube in the embodiment of the present invention.

First, as shown in FIG. 3, the desired black matrix film 7 is formed by coating the inner surface of a glass panel 1 with a photosensitive material, exposing and developing the photosensitive material properly to form the desired photosensitive pattern, coating the inner surface of the glass panel 1 with a graphite slurry, which is a black substance, and removing the photosensitive pattern with a reverse liquid, as in the prior art. In this case, in the glass panel 1, not only the black matrix film 7 is formed on a front inner wall 4, but also an unnecessary black substance coating film 8 is formed on a skirt inner wall 5 and a sealing surface 6.

Figure 4:
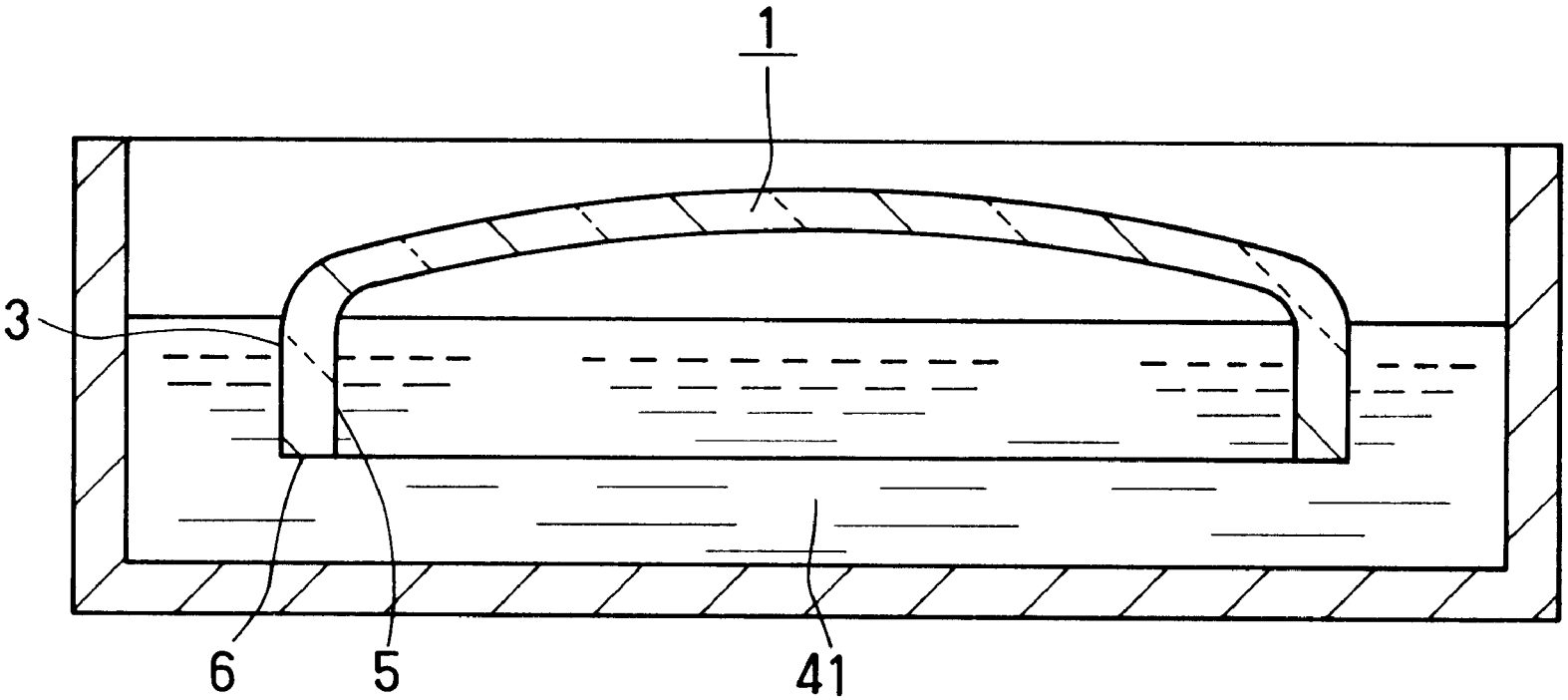
FIG. 4 is a sectional side view showing the step of immersing the glass panel in a glass dissolving liquid in the method for manufacturing a cathode ray tube in the embodiment of the present invention.

Next, as shown in FIG. 4, the skirt inner wall 5 and the sealing surface 6 of the glass panel 1 are immersed in a glass dissolving liquid 41, such as hydrogen fluoride or ammonium fluoride, to perform etching for a predetermined time. Thus, the dry black substance coating film (not shown) is dissolved together with the surface of the glass panel 1 (the outer and inner surfaces of a skirt portion 3 and the sealing surface 6, each of which is in contact with the glass dissolving liquid 41) and substantially removed. After the etching is finished, the glass panel 1 is pulled up from the glass dissolving liquid 41.

Figure 1:
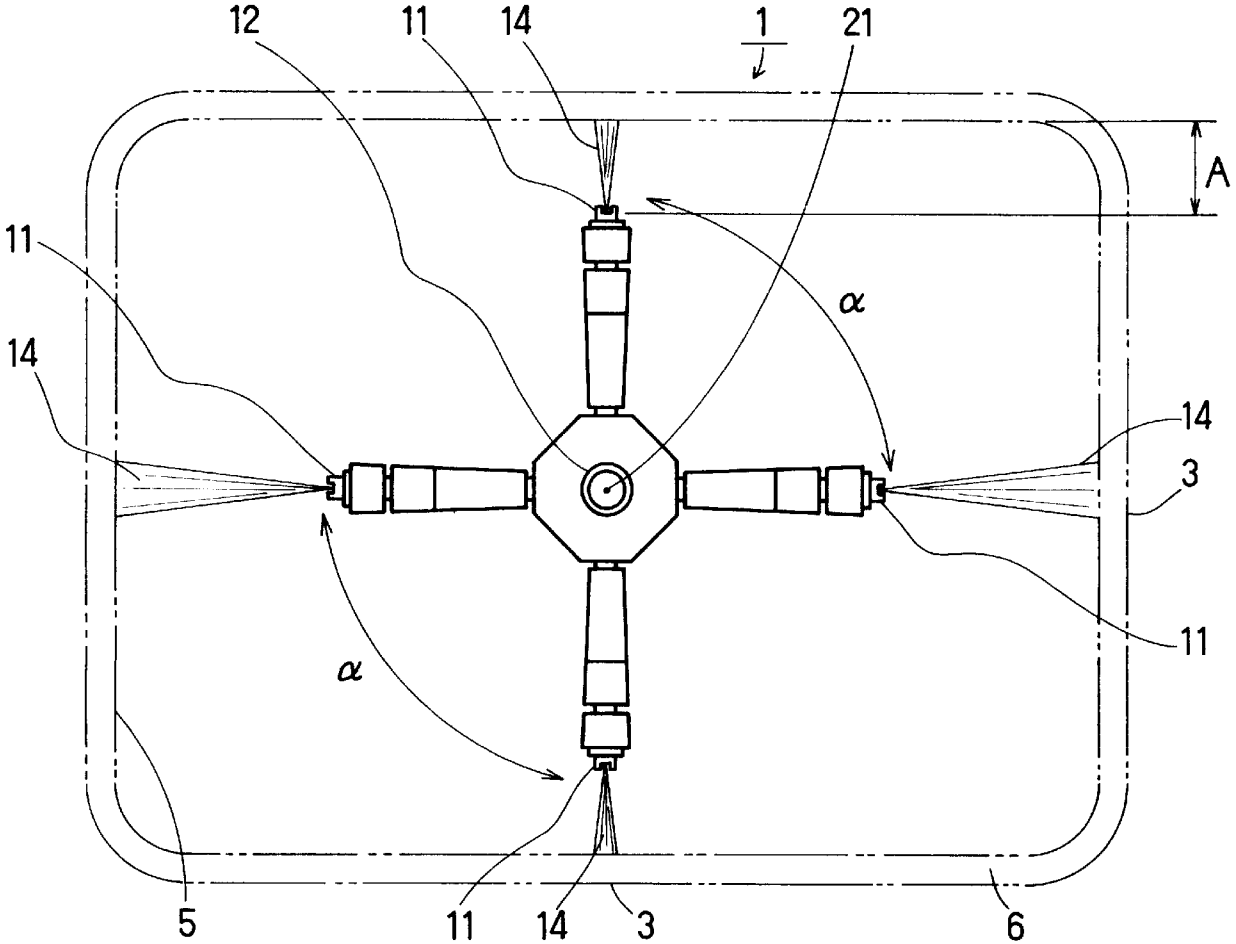
FIG. 1 is a plan view showing the step of removing a black substance coating film in a method for manufacturing a cathode ray tube in an embodiment of the present invention as seen from the upper surface of a glass panel.
Figure 2:
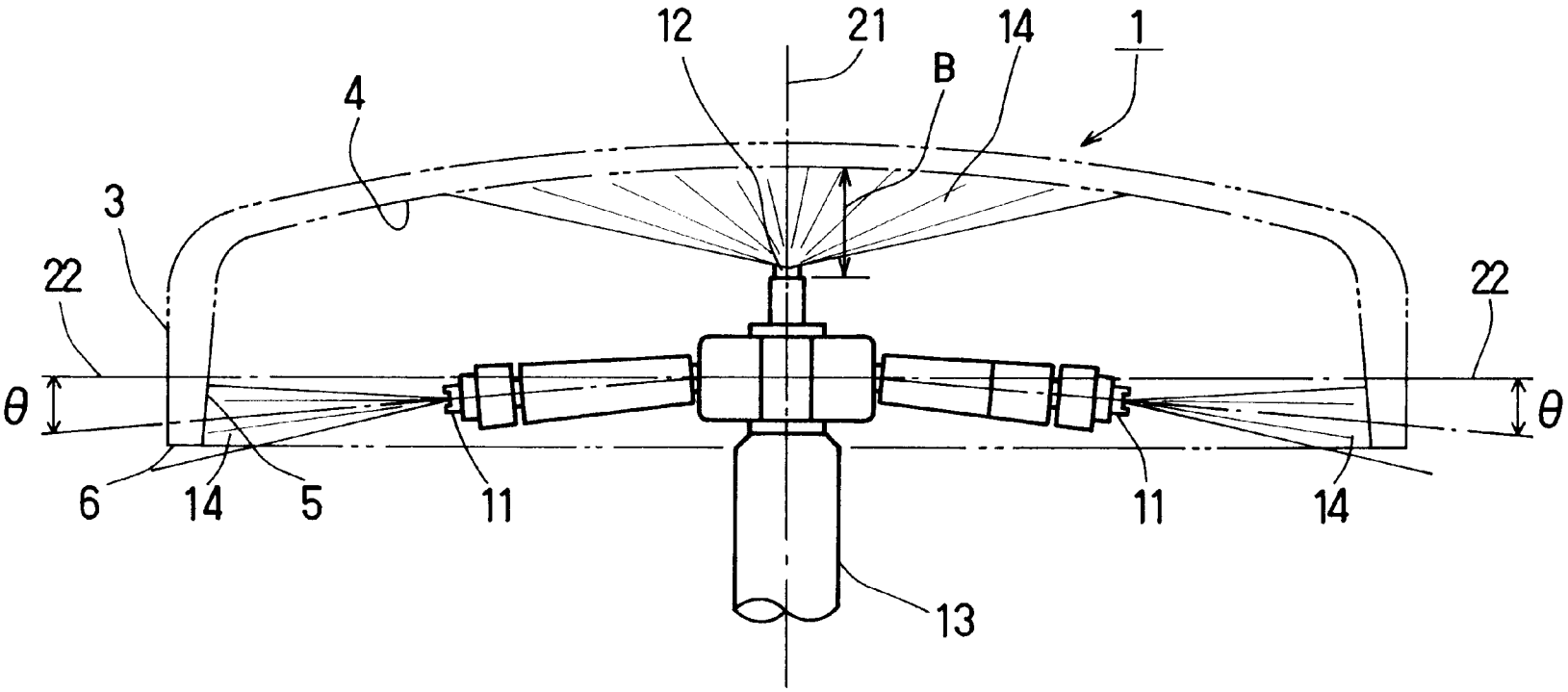
FIG. 2 is a side view showing the step of removing the black substance coating film in the method for manufacturing a cathode ray tube in the embodiment of the present invention as seen from a side of the glass panel.
Figure 5:
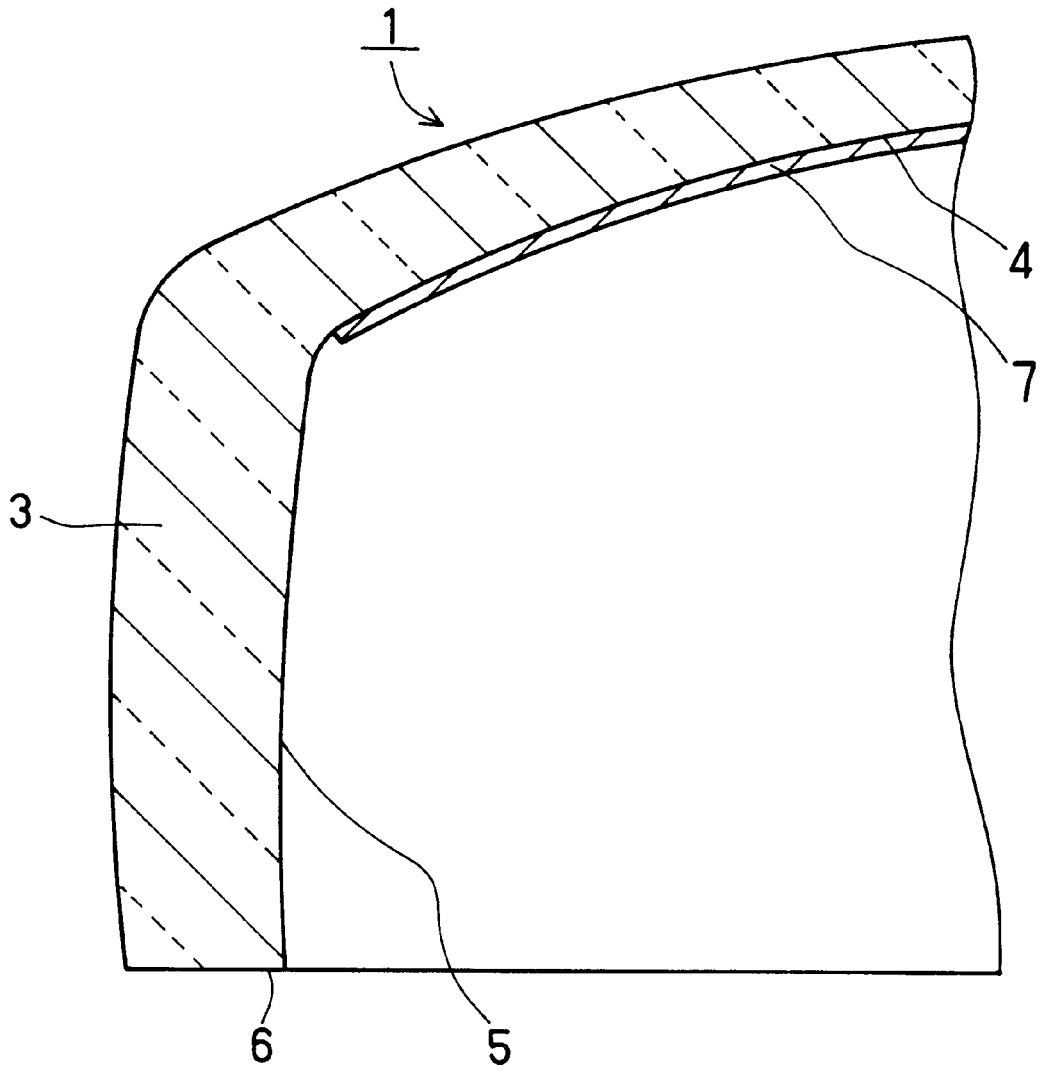
FIG. 5 is a sectional side view of the glass panel after removing the black substance coating film in the method for manufacturing a cathode ray tube in the embodiment of the present invention.

Next, as shown in FIGS. 1 and 2, a high-pressure cleaning liquid 14 is sprayed on the skirt inner wall 5 and the sealing surface 6 of the skirt portion 3 of the glass panel 1 from nozzles 11 for cleaning the skirt portion. Thus, the excess black substance coating film remaining on the skirt inner wall 5 and the sealing surface 6 is completely cleaned and removed to form the desired black matrix film 7 on the front inner wall 4 of the glass panel 1 as shown in FIG. 5.

As shown in FIGS. 1 and 2, four nozzles 11 for cleaning the skirt portion are provided radially around a nozzle support 13 provided on the central axis 21 of the glass panel 1 (corresponding to the tube axis of the cathode ray tube). (In FIG. 2, the illustration of the nozzle for cleaning the skirt portion on this side of the sheet is omitted.) The cleaning liquid 14 can be sprayed substantially uniformly over the entire area of the skirt inner wall 5 and the sealing surface 6 by rotating the four nozzles 11 for cleaning the skirt portion around the nozzle support 13 (the central axis 21 of the glass panel 1). In this case, the glass panel 1 may be rotated around the central axis 21, or the glass panel 1 and the nozzles 11 for cleaning the skirt portion may be rotated in opposite directions to each other. If the glass panel 1 and the nozzles 11 for cleaning the skirt portion are rotated in opposite directions to each other, the pressure of the cleaning liquid 14 increases when the cleaning liquid 14 reaches the skirt inner wall 5 and the sealing surface 6. Therefore, the effect of removing the black substance coating film 8 adhered to the skirt inner wall 5 and the sealing surface 6 can be improved. As a result, the unnecessary black substance coating film 8 can be removed in a short time, which improves the productivity. In addition, the time during which the etchant scatters on the inner surface of the glass panel 1 can be shortened, providing no adverse effect (for example, peeling of the black matrix film 7) on the formation of the black matrix film 7 on the front inner wall 4 of the glass panel 1. Furthermore, the odor of the etchant in the black matrix film 7 can be reduced, and the degree of vacuum of the cathode ray tube can be increased.

The nozzles 11 for cleaning the skirt portion are not limited to nozzles that are rotated in one direction at a constant angular velocity. The nozzles 11 may be reciprocated in the range of a predetermined angle $\alpha$ as shown in FIG. 1. When the nozzles 11 for cleaning the skirt portion are reciprocated in the range of a predetermined angle $\alpha$, the pressure direction of the cleaning liquid 14 with respect to the skirt inner wall 5 and the sealing surface 6 is changed. Therefore, the effect of removing the black substance coating film 8 adhered to the skirt inner wall 5 and the sealing surface 6 can be improved. As a result, the unnecessary black substance coating film 8 can be removed in a short time, which improves the productivity. In addition, the time during which the etchant scatters on the inner surface of the glass panel 1 can be shortened, providing no adverse effect (for example, peeling of the black matrix film 7) on the formation of the black matrix film 7 on the front inner wall 4 of the glass panel 1. Furthermore, the odor of the etchant in the black matrix film 7 can be reduced, and the degree of vacuum of the cathode ray tube can be increased.

In addition, the number of the nozzles 11 for cleaning the skirt portion can be determined properly according to the form of the region to be cleaned and the tolerance for the processing time of the manufacturing step.

It is preferable to spray the cleaning liquid 14 on the skirt inner wall 5 and the sealing surface 6 while spraying the cleaning liquid 14 on the front inner wall 4 of the glass panel 1 by using a nozzle 12 for cleaning the front portion in addition to the nozzles 11 for cleaning the skirt portion, as shown in FIGS. 1 and 2. When the cleaning liquid 14 is sprayed on the skirt inner wall 5 and the sealing surface 6, the glass dissolving liquid 41 (see FIG. 4) adhered to the skirt inner wall 5 and the sealing surface 6 can scatter on the front inner wall 4, damaging the black matrix film 7 (see FIG. 3). However, when the cleaning liquid 14 is sprayed on the front inner wall 4 at the same time, the inner surface of the glass panel 1 is protected by the cleaning liquid 14. Therefore, the glass dissolving liquid 41 can be prevented from adhering to the front inner wall 4. In this case, it is preferable to spray the cleaning liquid 14 uniformly and axisymmetrically with respect to the central axis 21 of the glass panel 1, toward substantially the entire area of the front inner wall 4 from the nozzle 12 for cleaning the front portion, as shown in FIG. 2. However, it is possible to clean the entire area of the front inner wall 4 in turn by rotating the nozzle 12 for cleaning the front portion around the nozzle support 13 while spraying the cleaning liquid 14 non-axisymmetrically with respect to the central axis 21 of the glass panel 1 (only on one side).

Furthermore, it is preferable to spray the cleaning liquid 14 on the front inner wall 4 of the glass panel 1 before removing the black substance coating film 8 adhered to the skirt inner wall 5 and the sealing surface 6. According to the preferable example, the inner surface of the glass panel 1 is protected by the cleaning liquid 14 before the glass dissolving liquid 41 adhered to the skirt inner wall 5 and the sealing surface 6 scatters on the front inner wall 4. Therefore, the effect on the formed black matrix film 7 can be reduced further.

After forming the desired black matrix film 7 on the front inner wall 4 of the glass panel 1 as described above, a glass funnel is connected to the sealing surface 6 of the glass panel 1, an electron gun is mounted in the neck portion of the glass funnel, and evacuation is performed. Thus, a cathode ray tube is obtained.

The present invention will be described below in more detail by way of example according to the manufacture of a 15-type (36-cm) cathode ray tube.

First, as shown in FIG. 3, the desired black matrix film 7 was formed by coating the inner surface of a glass panel 1 with a photosensitive material, exposing and developing the photosensitive material properly to form the desired photosensitive pattern, coating the inner surface of the glass panel 1 with a graphite slurry, which is a black substance, and removing the photosensitive pattern with a reverse liquid. As the photosensitive material, polyvinyl alcohol (PVA), polyvinyl pyrrolidone (PVP) or the like can be used. As the reverse liquid, hydrogen peroxide, sulfamic acid, periodic acid or the like can be used.

Next, as shown in FIG. 4, a predetermined cleaning region of the skirt inner wall 5 and the sealing surface 6 of the glass panel 1 was immersed in a glass dissolving liquid 41 including a mixed liquid of hydrogen fluoride and ammonium fluoride. The concentration of each of hydrogen fluoride and ammonium fluoride is preferably in the range of 3 to 10%. The immersion time is preferably in the range of 5 to 15 sec.

Next, as shown in FIGS. 1 and 2, a high-pressure deionized water (a cleaning liquid 14) was injected from nozzles 11 for cleaning the skirt portion and a nozzle 12 for cleaning the front portion to sufficiently clean the front inner wall 4 of the glass panel 1, the skirt inner wall 5 and the sealing surface 6 of a skirt portion 3. Thus, an excess black substance coating film 8 was removed to form the desired black matrix film 7 as shown in FIG. 5. The injection pressure of the deionized water (the cleaning liquid 14) is preferably in the range of 0.2 to 1 MPa. The injection time of the deionized water (the cleaning liquid 14) is preferably in the range of about 5 to 20 sec. The injection amount of the deionized water (the cleaning liquid 14) is preferably in the range of about 0.3 to 1.0 liter/min.

The distance A from the nozzle 11 for cleaning the skirt portion to the skirt inner wall 5 (see FIG. 1) is preferably in the range of 30 to 50 mm on the long side of the glass panel 1. The distance B from the nozzle 12 for cleaning the front portion to the front inner wall 4 (see FIG. 2) is preferably in the range of 15 to 25 mm.

It is preferable to provide the nozzles 11 for cleaning the skirt portion inclined to some degree in the opposite direction to the front inner wall 4 of the glass panel 1 with respect to a plane 22 perpendicular to the central axis 21 of the glass panel 1 as shown in FIG. 2, rather than providing the nozzles 11 on the plane 22. The suitable angle of inclination θ is 2 to 6°. By thus inclining the nozzles 11 for cleaning the skirt portion with respect to the plane 22 perpendicular to the central axis 21 of the glass panel 1, the scattering of the black substance, the etchant and the like onto the front inner wall 4 of the glass panel 1 can be reduced. As a result, the formation of the black matrix film 7 on the front inner wall 4 of the glass panel 1 is not adversely affected. Furthermore, the odor of the etchant in the black matrix film 7 can be reduced, and the degree of vacuum of the cathode ray tube can be increased.

The rotation frequency at which the nozzles 11 for cleaning the skirt portion are rotated around the nozzle support 13 is preferably in the range of 10 to 50 rpm. As shown in FIG. 1, in this example, the nozzles 11 for cleaning the skirt portion are set to reciprocate in the range of a predetermined angle α. The angle α is preferably in the range of 90 to 110°.

When the deionized water (the cleaning liquid 14) was sprayed on the skirt inner wall 5 and the sealing surface 6 of the skirt portion 3 under the above conditions, the excess black substance coating film 8 was sufficiently removed. In addition, by cleaning the skirt inner wall 5 and the sealing surface 6 of the skirt portion 3 and cleaning the front inner wall 4 of the glass panel 1 at the same time, inconveniences caused by the odor of fluorine, the splashing of dirty water, and the like, which were harmful to the life of the cathode ray tube, were eliminated.

In this example, the excess black substance coating film was cleaned and removed with the deionized water. However, the same effects can be obtained by cleaning with a hot deionized water. In addition, industrial water (general water) can be used as the cleaning liquid 14. In this case, cleaning with deionized water or hot deionized water is necessary after using the industrial water.

Figure 6:
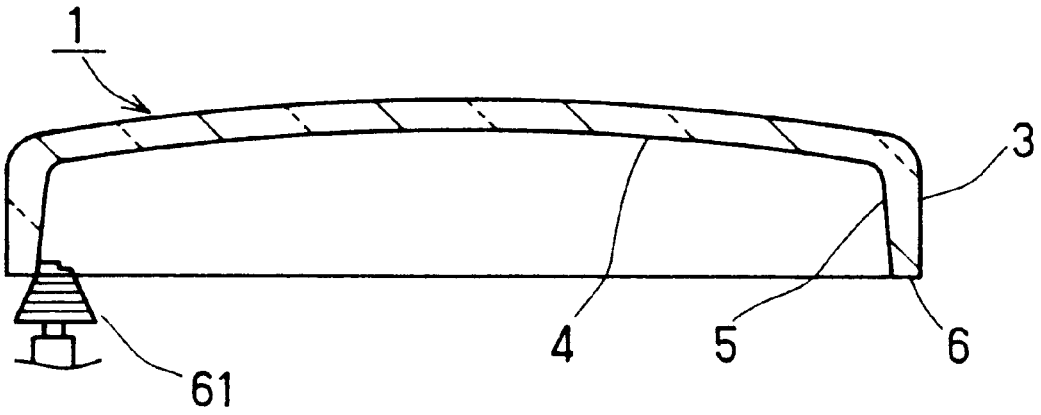
FIG. 6 is a side view showing another aspect of the step of removing the black substance coating film in the method for manufacturing a cathode ray tube in the embodiment of the present invention as seen from a side of the glass panel.
Figure 7:
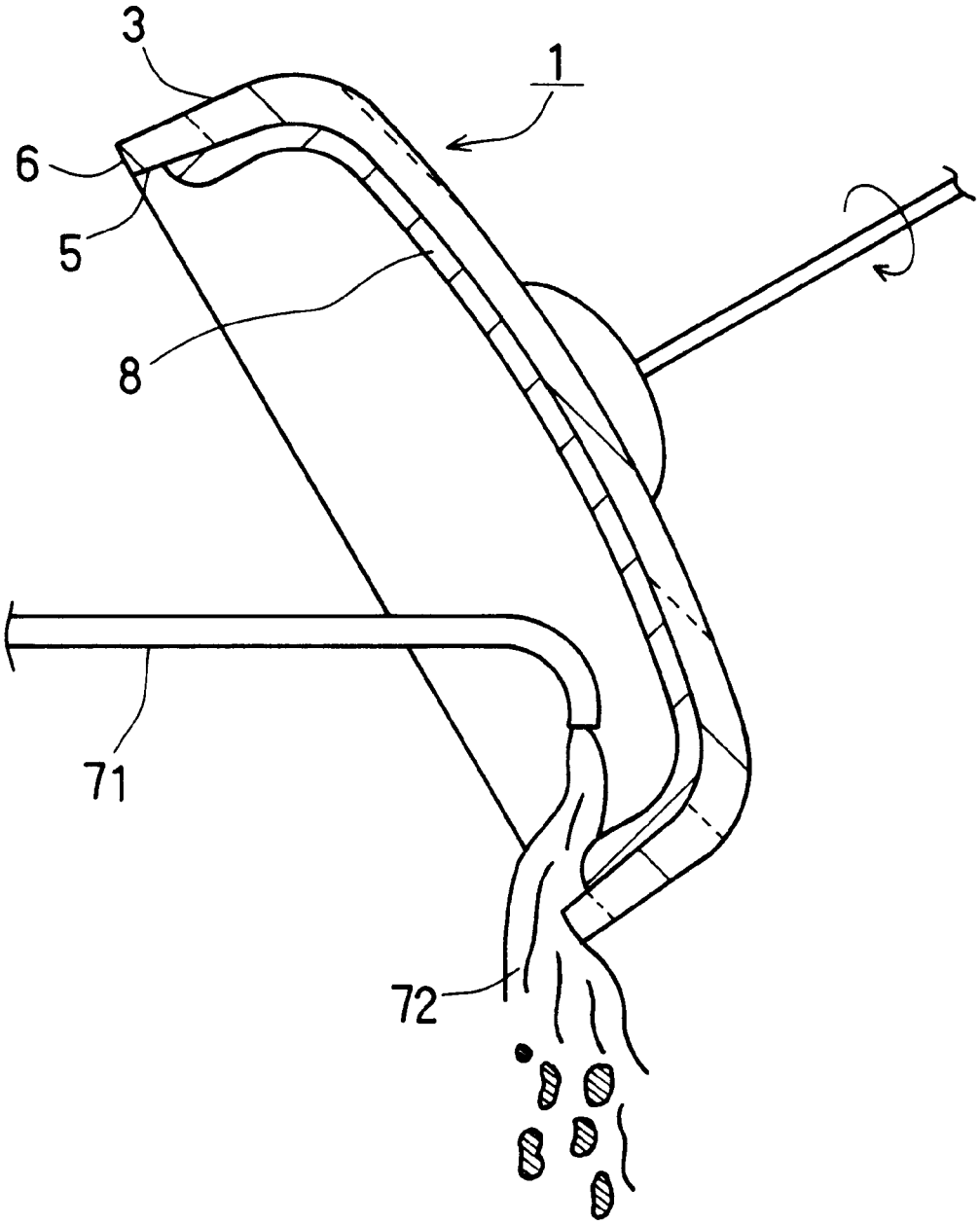
FIG. 7 (PRIOR ART)
FIG. 7 is a side view showing an example of the step of removing a black substance coating film in a method for manufacturing a cathode ray tube in the prior art as seen from a side of a glass panel.

In this example, the excess black substance coating film 8 adhered to the skirt inner wall 5 and the sealing surface 6 of the skirt portion 3 was removed by spraying the cleaning liquid 14. However, the means for removing the excess black substance coating film 8 is not limited to the means for spraying the cleaning liquid 14. For example, as shown in FIG. 6, a mechanical method of removing the excess black substance coating film 8 by contacting a brush 61 (or a sponge) with the skirt inner wall 5 and the sealing surface 6 may be used. However, when employing the method of removing the excess black substance coating film 8 adhered to the skirt inner wall 5 and the sealing surface 6 of the skirt potion 3 by spraying the cleaning liquid 14, the following problems: the problem that when the brush 61 or the like is worn away, the stem portion inside the brush contacts the skirt inner wall 5 and the sealing surface 6, creating minute flaws in these portions; the problem that the brush 61 must be exchanged periodically; and the problem that production loss occurs due to the maintenance and difficulties of manufacturing facilities, are avoided unlike with the mechanical method using the brush 61 or the like.

The invention may be embodied in other forms without departing from the spirit or essential characteristics thereof. The embodiments disclosed in this application are to be considered in all respects as illustrative and not limitative, the scope of the invention is indicated by the appended claims rather than by the foregoing description, and all changes which come within the meaning and range of equivalency of the claims are intended to be embraced therein.

What is claimed is:

1. A method for manufacturing a cathode ray tube, comprising:

applying a black substance to an inner surface of a glass panel;

immersing a skirt inner wall and a sealing surface of the glass panel in a glass dissolving liquid for etching; and removing the black substance adhered to the skirt inner wall and the sealing surface by a removing means while spraying a cleaning liquid on the inner surface of the glass panel, thereby forming a desired black matrix film on a front inner wall of the glass panel.

2. The method for manufacturing a cathode ray tube according to claim 1, wherein the cleaning liquid is sprayed on the front inner wall of the glass panel before the black substance adhered to the skirt inner wall and the sealing surface is removed by the removing means.

3. The method for manufacturing a cathode ray tube according to claim 1, wherein the removing means is means of spraying the cleaning liquid on the skirt inner wall and the sealing surface.

4. The method for manufacturing a cathode ray tube according to claim 1, wherein at least one discharge opening for cleaning a skirt portion is provided from a discharge opening support on a central axis of the glass panel toward the skirt inner wall and the sealing surface, and the cleaning liquid is sprayed on the skirt inner wall and the sealing surface from the discharge opening for cleaning the skirt portion.

5. The method for manufacturing a cathode ray tube according to claim 4, wherein the cleaning liquid is sprayed on the skirt inner wall and the sealing surface from the discharge opening for cleaning the skirt portion while rotating at least one of the glass panel and the discharge opening for cleaning the skirt portion around the central axis of the glass panel.

6. The method for manufacturing a cathode ray tube according to claim 5, wherein the glass panel and the discharge opening for cleaning the skirt portion are rotated in opposite directions to each other.

7. The method for manufacturing a cathode ray tube according to claim 5, wherein a plurality of the discharge openings for cleaning the skirt portion are provided, and each of the discharge opening for cleaning the skirt portion is reciprocated in a predetermined angle range.

8. The method for manufacturing a cathode ray tube according to claim 4, wherein the discharge opening for cleaning the skirt portion is inclined at a predetermined angle on an opposite side to the front inner wall of the glass panel with respect to a plane perpendicular to the central axis of the glass panel.

9. The method for manufacturing a cathode ray tube according to claim 8, wherein the predetermined angle is in the range of 2 to 6°.

10. The method for manufacturing a cathode ray tube according to claim 4, wherein a discharge opening for cleaning a front portion is provided in an upper portion of the discharge opening support, and the cleaning liquid is sprayed on the front inner wall of the glass panel from the discharge opening for cleaning the front portion.

* * * * *